United States Patent [19]

Bansal

[11] Patent Number: 4,491,317

[45] Date of Patent: Jan. 1, 1985

[54] ELECTRICALLY POWERED SWING FOR INFANT

[76] Inventor: Arun K. Bansal, 8215 Harding, Skokie, Ill. 60076

[21] Appl. No.: 388,750

[22] Filed: Jun. 16, 1982

[51] Int. Cl.[3] ..... A63G 9/16

[52] U.S. Cl. ..... 272/86

[58] Field of Search ..... 272/86; 297/260; 5/108, 5/109; 248/370

[56] References Cited

U.S. PATENT DOCUMENTS

| | | | |
|---|---|---|---|
| 3,031,687 | 5/1962 | Stevens et al. | 5/109 |
| 3,261,032 | 7/1966 | Reardon | 5/108 |
| 3,667,756 | 6/1972 | Barrett | 272/86 |
| 3,842,450 | 10/1974 | Pad | 5/109 |
| 4,150,820 | 4/1979 | Bochmann | 272/86 |
| 4,211,401 | 7/1980 | Cunard | 272/86 |

FOREIGN PATENT DOCUMENTS

| | | | |
|---|---|---|---|
| 499812 | 2/1954 | Canada | 272/86 |
| 1021502 | 11/1977 | Canada | 5/108 |
| 631026 | 10/1949 | United Kingdom | 272/86 |

*Primary Examiner*—Robert A. Hafer
*Assistant Examiner*—Arnold W. Kramer
*Attorney, Agent, or Firm*—Alfred D. Lobo

[57] ABSTRACT

An infant's swing is disclosed which has a simple construction including a stationary main frame and a reciprocable infant-swinging structure. The swing may be operated with a commercially available rechargeable or alkaline battery or transformer supplying current at no more than about 24 volts. The low voltage current is used to actuate a solenoid fixedly mounted on the main frame in a unique manner so as to use a compensating extensible spring. This spring drivingly engages an infant's seat while simultaneously compensating for the difference between the linear velocity of the solenoid's plunger and the angular velocity of hangers supporting the reciprocable seat. Current is supplied to the solenoid in pulses having a duration of less than about 0.5 second so as to conserve the battery. The swing may also be operated with a D-C transformer providing current at about 2 amperes and preferably 3 or 4 volts.

8 Claims, 7 Drawing Figures

ELECTRICALLY POWERED SWING FOR INFANT

BACKGROUND OF THE INVENTION

This invention is related to a device for reciprocably swinging an infant in a pendulum motion, which motion is supplied by a solenoid-actuated power arm. The infant is placed in an infant-support means ("seat") which is supported by elongated struts ("hangers"). The assembly of seat and hangers comprises an infant-swinging means which may be a "rocking cradle" or swing (either of which are hereafter referred to as "swing" for brevity).

It is known that oscillatory motion is routinely supplied for numerous operations by electrically powered solenoid means with appropriate switching means. However, the precise manner in which reciprocation provided by a solenoid means may be effectively translated to desirable reciprocatory motion of an automatic swing, yet maintaining proper timing, is far from clear, for numerous reasons.

Heretofore, the power requirements for reciprocating a swing have dictated electric motor-driven, or mechanically actuated means for providing the swinging motion (oscillatory movement) of the swing, and the devices became expensive to manufacture. Such electric motor-driven swings are disclosed in U.S. Pat. Nos. 3,031,687 and 3,146,985; a spring-powered motor is disclosed in U.S. Pat. No. 3,371,358. Again, because of the relatively high power required to keep a swing swinging, electromagnetic coils have been energized to exert a magnetic pull on an armature during each oscillation, which pull compensates for and overcomes the loss of momentum as the swing falls through one portion of its arc (the "down" arc) and continues into the other portion of its arc (the "up" arc). Typical of such devices are those described in U.S. Pat. Nos. 3,261,032 and 3,883,136.

A specially designed solenoid-driven swing is disclosed in U.S. Pat. No. 3,842,450, but its power requirements are such that it is inoperable except with a main electric supply.

Though, theoretically, the cost of a power-operated swing for an infant bears only ever so slightly on considerations of what structural features may be combined to provide the desired reciprocatory motion, the simple fact remains that cost is the first of two all-important considerations which determine the marketability of such a device. The second consideration is safety.

It is unnecessary to dwell upon the heightened safety-consciousness of the child-rearing public whose proper concern is voiced by various governmental agencies striving to provide child-safe devices for the benefit of young children unable to weigh or act upon such considerations themselves. This is especially true for infants up to about two (2) years old who weigh about 20 lb (pounds). It is equally unncessary to discuss the possible hazards associated with power-operated children's playthings and artifacts, particularly swings, which require that they be direct-main-powered, that is, connected to electric mains carrying 110 volts or more, and conventionally fused at a minimum of 10 amps, so that danger is within easy reach of the infant. It is therefore not surprising that, to my knowledge, no electrically-powered infant's swing has been successfully marketed. The problem has been to provide an inexpensive swing which can be battery-operated with either an inexpensive, commercially available disposable alkaline battery, or a rechargeable sealed lead-acid or nickel-cadmium battery, or a D-C adapter (transformer) which is a source of current, all of which provide current at a voltage no more than about 24 volts, preferably 3 or 4 volts, and at low amperage. Where a rechargeable battery is used, it should provide operation of the swing for several hours before it requires recharging. The demand of the marketplace has been for a child-safe swing which will operate reliably and relatively long, yet be reasonably sale-priced. All solutions proffered to date have inevitably provided operational unreliability italicized by the necessity to provide high quality components at low cost. This invention fulfills the long-felt need for a highly marketable, child-safe and reliable device which will operate for several hours continuously even on a commercially available rechargeable battery, requiring only that the oscillatory movement of the swing be initiated manually when the infant is placed in the seat.

SUMMARY OF THE INVENTION

It has been discovered that an infant's swing having a simple construction including a stationary main frame and a reciprocable infant-swinging structure, may be operated with a commercially available rechargeable or alkaline battery or transformer supplying current at no more than about 24 volts, provided such a source of low voltage current is used to actuate a solenoid fixedly mounted on the main frame in a unique manner so as to use a compensating extensible spring means to drivingly engage the infant-supporting means while simultaneously compensating for the difference between the linear velocity of the solenoid's plunger and the angular velocity of the struts supporting the reciprocable structure.

It has further been discovered that if a solenoid is mounted at an angle of about 45° and a microswitch for its actuation is so positioned as to provide a short-duration impulse, the power of the battery is conserved so as to enable it to sustain reciprocation of the swing for a period of up to five (5) hours with 2 'C' or 'D' cells without recharging them, provided reciprocation is initiated manually.

It has still further been discovered that a swing structure utilizing the particular relationship of a power arm driven through an extensible spring means by an angularly mounted solenoid may be used to build a swing without a single main shaft which supports both sides of an infant supporting structure ("seat"). Instead, a pair of stub shafts are oppositely disposed for rotation in bearing means supported on inverted-U support members, each stub shaft supporting an elongated strut ("hanger") for hanging the seat.

BRIEF DESCRIPTION OF THE DRAWINGS

The foregoing and other objects and advantages of my invention will appear more fully from the following description, made in connection with the accompanying drawings of preferred embodiments of the invention, wherein like reference characters refer to the same or similar parts throughout the several views and in which.

DETAILED DESCRIPTION OF PREFERRED EMBODIMENTS

Figure 1:
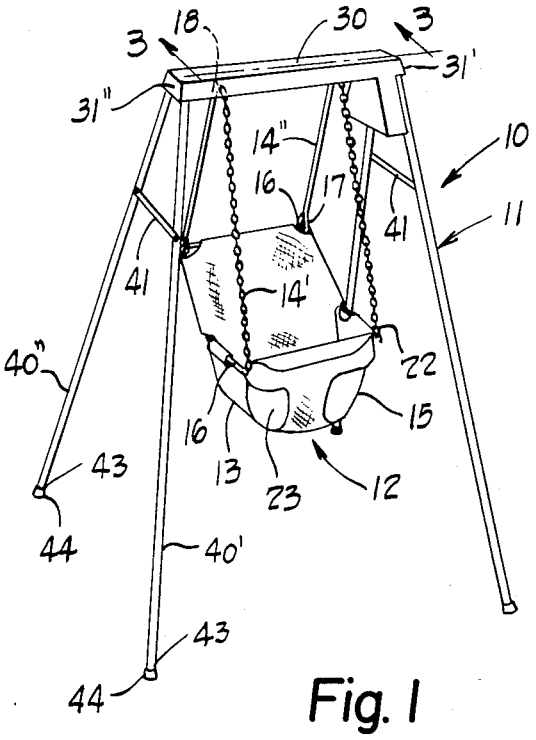
FIG. 1 is a perspective view from a slight elevation showing a typical infant's swing in which the seat is supported by hangers removably disposed in hanger blocks on a main shaft.

Referring to the drawings for a more detailed description of preferred embodiments of my invention, FIG. 1 illustrates in perspective view from a slight elevation, a first preferred embodiment of a novel and unobvious swing, indicated generally by reference numeral 10, comprising a stationary main frame indicated generally by reference numeral 11 and a reciprocable infant-swinging structure indicated generally by reference numeral 12.

The particular design details of the infant-swinging structure 12, commonly referred to as a rocking cradle or swing (and hereafter referred to as "swing"), are not critical provided that the infant be supported in a reclining, supine or semi-sitting position exemplified by a person resting on a lawn chair in which the seat and back-supporting portions are at an obtuse angle (greater than 90°). Such a swing typically includes an assembly of an infant-support means or seat 13, and front and rear elongated struts or hangers 14' and 14" respectively, from which the seat is supported.

The seat 13 typically is constructed by lacing or otherwise attaching an arcuately shaped deformable web 15 to a rigid seat frame 16 which will not be permanently distorted by the weight of a small child. The rear hangers 14" may be relatively rigid being formed from wire stock, for example, 5/32" carbon steel wire which is zinc plated. One (lower) end of each rear hanger 14" forms an 'eye' 17 through which the seat frame 16 is inserted. The other (upper) end of the hanger is bent to provide a short stub-end 18 which is inserted through a hanger block 19 keyed or otherwise fixedly disposed on a support shaft means 20 for to-and-fro reciprocation therewith. One (upper) end of the front hanger 14' is attached to the stub end 18 and the other (lower) end 22 of the hanger is attached to the seat frame 16. Both the front and rear hangers 14' and 14" may be made from the wire stock but it is preferred to have the front hangers 14' made from flexible support means such as chain stock for convenience in placing and removing an infant from the seat 13. The web 15 is preferably provided with cut-outs so that, the seat 13 includes openings 23 through which the infant's legs may be inserted when the infant is in a reclining, supine or semi-sitting position.

As will presently be evident, this reclining, supine or semi-sitting position of the infant in the seat is essential if the infant is not to affect the automatic to-and-fro swinging motion of the swing, once it is initiated. If the infant were to lean forward against the front of the seat frame 16, it will disrupt the balanced automatic motion of the swing, and it will soon come to a halt.

Figure 3:
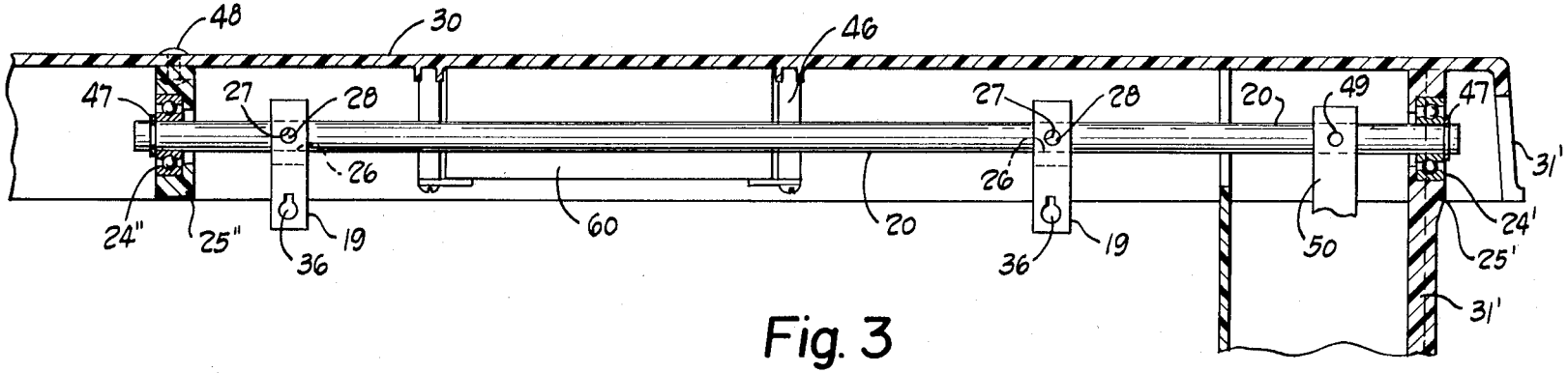
FIG. 3 is a frontal cross sectional view along line 3—3 in FIG. 1 showing details of the main shaft mounted in the housing of the main frame.

The support shaft means in FIG. 1 is the main shaft 20 which is rotatably supported in low-friction bearing means 24' and 24" such as roller bearings held in pillow blocks 25' and 25" preferably integrally formed in a relatively rigid main housing 30 (see FIG. 3). The housing 30 is preferably injection-molded or otherwise thermoformed from a synthetic resinous material such as a polyolefin, polyamide or ABS (acrylonitrile-butadiene-styrene) resin, or from a thermosetting resin which is suitably reinforced. The housing 30 is provided with end walls 31' and 31" to which support legs 40' and 40" are removably or foldably attached. The legs are preferably made from thin-walled tube stock, for example, 0.625" (inch) nominal diameter tubing having a wall thickness of about 0.029"; or, from relatively rigid wire stock which will not flex when supporting a swinging infant.

End wall 31' is generally triangularly shaped and extends downwardly for a sufficient distance to afford mounting for a solenoid 56, an on-off switch 57, a microswitch 58, and a power jack 59 for electrical connection with a battery or D-C transformer 60, the functions of which will be explained in greater detail hereinafter. It is not critical whether the battery 60 be 'wet' or 'dry cell' but whatever the source of current it is necessarily provided at a voltage less than 24 volts, preferably about 3 or 4 volts, and at less than 6 amperes, preferably at about 2 amperes. The solenoid 56 is selected for intermittent service with direct current. For example, when operating with a 4 volt battery, a No. 4 HD intermittent service solenoid manufactured by Guardian Electric Co. of Chicago, Ill. is most preferred.

The end wall 31' has side walls 32' and 32" which serve, along with a cover 33 to enclose the aforementioned components. The cover 33 is removably attached to the housing's elongated body, on top thereof, with mounting screws 34; and, to the end wall 31' with mounting screws 35. The elongated body of the housing 30 resembles an inverted dish having a generally trapezoidal shape, and is reinforced with appropriate ribbing to provide adequate strength to swing the infant.

Also, for structural strength, each pair of legs is provided with a brace 41 bolted to projecting brackets or tabs 42 on the legs. The ground-engaging ends 43 of the legs are preferably provided with rubber end caps 44 to protect the floor's surface, or a flooring covering thereon, and at the same time to provide the desired frictional engagement to avoid 'walking' of the swing while it is in operation.

Referring now to FIG. 3, there is shown a frontal cross-sectional view along the line 3—3 in FIG. 1 showing the housing 30 and the main shaft 20 supported in pillow blocks 25' and 25". Hanger blocks 19 are held to the main shaft with spring pins 28 and rotate with the shaft. The hanger blocks may be made from metal but are more preferably made from glass reinforced nylon. A through-bore 26 in each hanger block slidably accommodates the main shaft 20, and a cross-bore 27 at right angle to and in open communication with bore 26, is provided for insertion of a spring pin 28.

A slot 29 in the lower portion of the hanger block allows an eye of a hanger to be placed therein and held with a pin 36 so that each hanger may be oscillated extending rigidly and radially from its hanger block, through an arc which is preferably less than about one-fourth of the circumference of a circle circumscribed by a radius equivalent to the length of a hanger, or less than $\pi/2$ radians.

Pillow block 25'' is removably affixed to the housing with mounting screws 48 but pillow block 25' is formed integrally in end wall 31'. End wall 31'' is dimensioned so as to provide a suitable location for removably or foldably attaching legs 40''. A mounting receptacle 46 for mounting the battery is molded integrally with the housing 30. It will be understood that the receptacle 46 will desirably be molded to snugly accommodate at least one, and preferably 2 cells (size C or D) which are rechargeable.

Figure 4:
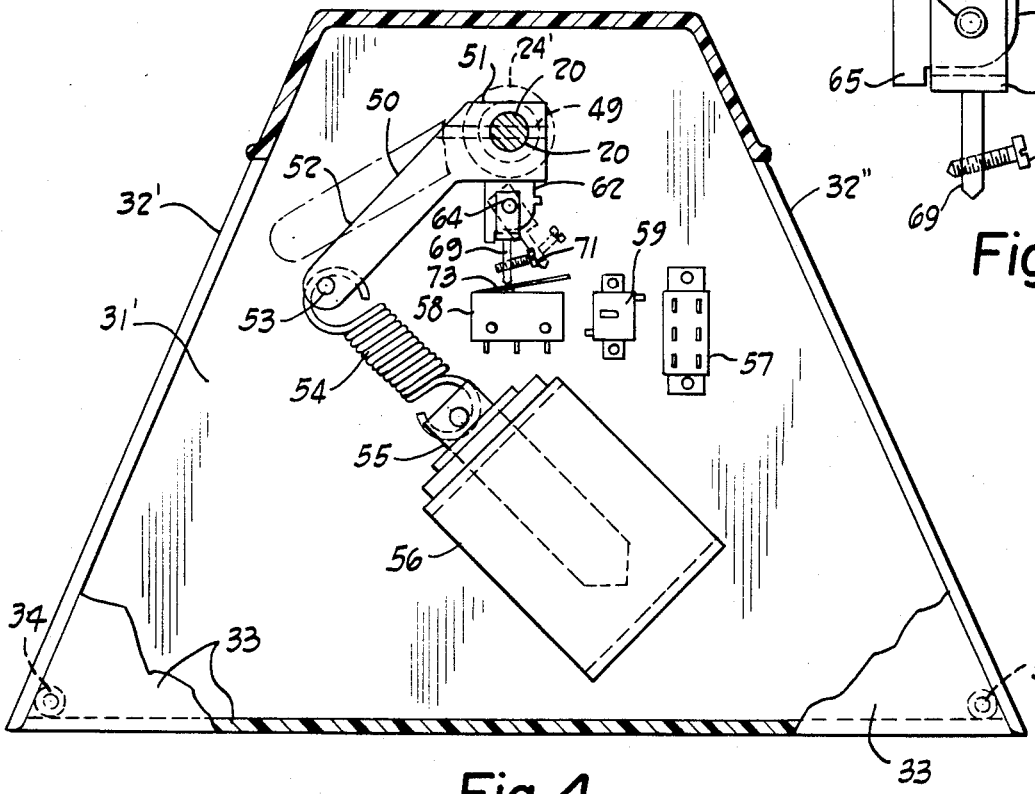
FIG. 4 is a side elevation view schematically illustrating the driving mechanism and components used in the swing of my invention.

Near the ends of the main shaft are provided retaining rings 47, and one end of the main shaft has attached thereto an angular L-shaped power arm 50 which is held with spring pin 49 to the main shaft 20, for oscillation therewith. As shown in FIG. 4, the power arm is so attached to the main shaft that it (the shaft) is centrally affixed in the shorter portion 51 of the L, and at rest, or the vertical position of the seat, the longitudinal axis of the longer portion 52 of the power arm is at about a 45° angle to the horizontal.

In the upward portion of the swing's pendulum motion towards the rear, (the "up" mode rearwards) the power arm is angularly displaced to the position shown in phantom outline. In the downward or "down" mode, an infant in the seat starts a downward arc which passes through the center (vertical axis) and continues upward and forward (the "up" mode forwards), urged upwards by the momentum generated in the "down" mode. Again, having reached the top of the forward arc, the infant commences the "down" mode going backwards until he passes through the center and goes to the top of the back arc in the "up" mode rearwards, completing the cycle.

Near the end of the power arm 50 there is provided an attachment means such as a rivet 53 to which one end of an extension spring 54 is attached. The other end of the extension spring is attached to a plunger 55 of the solenoid means 56 fixedly disposed on the main frame, and reciprocation of the swing is actuated by the solenoid. The stroke of the plunger is preferably in the range from about 1'' to about 2''. The extension spring is most preferably a helical extension spring having a spring rate in the range from about 20 lb/in to about 35 lb/in, though any other extensible spring means with a spring constant small enough to permit extension of the spring by the momentum of the infant travelling to the top of the back arc will be suitable, provided the spring constant is not so small that it will negate the pulling effect of the solenoid's plunger when the solenoid is actuated. A suitable spring is a No. LE-063E-1 made from 0.063'' (inch) diameter spring wire by Lee Spring Co. of Brooklyn, N.Y.

The solenoid is necessarily mounted at an angle of about 45° from the vertical so that the pulling force of the plunger 55 will be substantially tangential to the back arc through which the power arm 50 is reciprocated, at a location near the top of the back arc. With this angular relationship between the power arm and the linearly reciprocating motion of the plunger of the solenoid 56, it will be seen that the pulling force is effectively transmitted to the power arm where the force exerts the maximum effect.

It will now further be noted that the linear velocity of the plunger is substantially constant, being a design feature of a conventional solenoid, but the angular velocity of the power arm will vary depending upon the weight of the infant, the initial displacement of the infant from center, which displacement is imparted by a manual thrust to initiate operation of the swing, and other factors. The extensible spring 54 has the effect of not only transmitting the force exerted by the plunger as it is retracted, but also of (a) compensating for differences in the linear velocity of the plunger and the angular velocity of the power arm when the velocities are mismatched, and (b) preventing current surges thereby conserving electrical energy.

Figure 5:
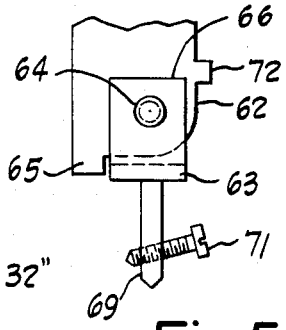
FIG. 5 is a detail view of a portion of the power arm assembly shown in FIG. 5, to illustrate the structure and action of the timing lever which is critical to providing pulses of current to the solenoid.
Figure 6:
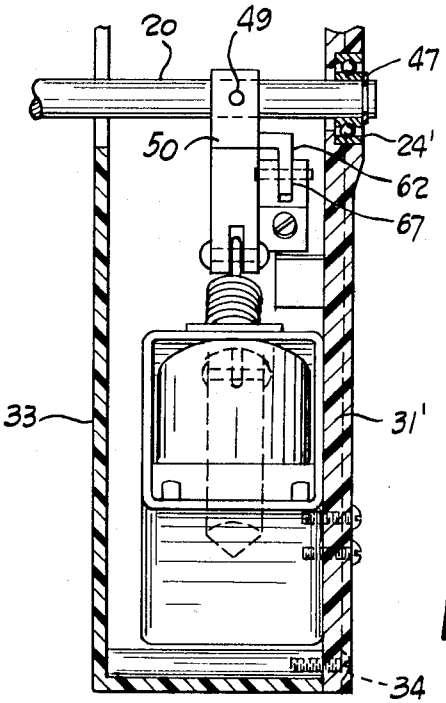
FIG. 6 is a front elevation view of the power arm assembly illustrated in FIG. 4.

Referring further to FIG. 4, and additionally to FIGS. 5 and 6, the power arm 50 is provided with an integral extension 62 which is laterally offset from the plane in which the power arm oscillates. The extension 62 extends downwardly for a short distance and there is pivotably disposed thereon a timing lever 63 which pivots in a limited arc about pivot pin 64. The lower portion of the integral extension 62 has a shoulder 65 to prevent the timing lever 63 from pivoting past the shoulder. Thus, with the timing lever resting against the shoulder, the timing lever is free to pivot in one direction only, namely clockwise, as illustrated in phantom outline.

As specifically illustrated in FIG. 5, timing lever 63 has an upper rectangular block portion 66 which is provided with a slot 67 to slidably accomodate an arcuate lower portion 68 of the extension 62 of the power arm. The lower portion of the timing lever 63 is a projecting finger 69 which is weighted with a screw 71 threadedly disposed therein. It is desirable for better performance, to provide a stop tab 72 to prevent the timing lever from being over-rotated for any reason, as it might be during shipping of the swing.

Figure 7:
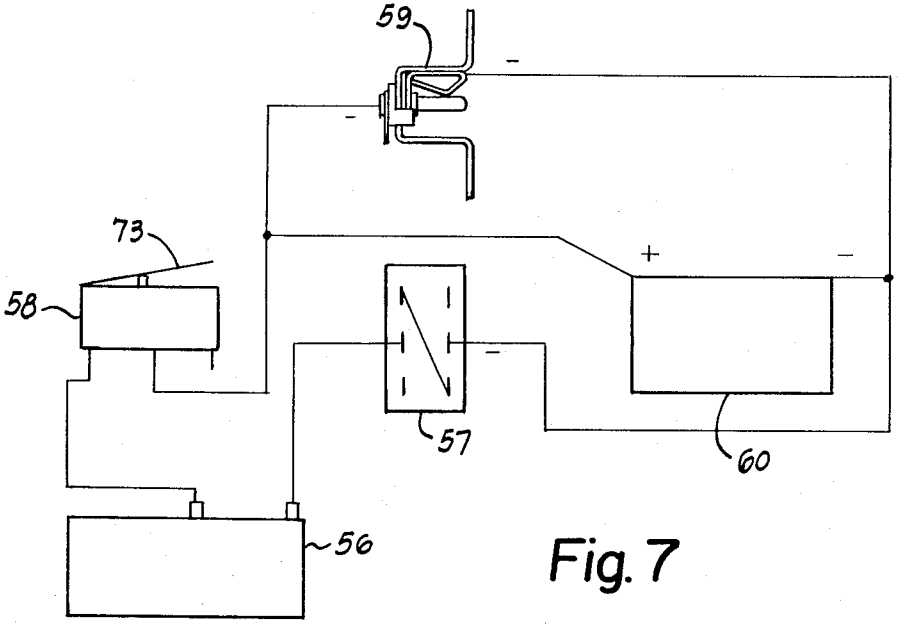
FIG. 7 is a electrical schematic showing the circuit for operation of my swing.

A microswitch 58 is demountably attached to the end wall 31' and is so located that the end of finger 69 can make intermittent contact through a return spring 73 on the microswitch as the finger oscillates. As is seen in the electrical schematic (FIG. 7), the battery or D-C power source is connected to a normally open microswitch through a power jack 59 and an ON-OFF switch 57, both of which are also mounted on end wall 31'. A fuse (not shown) is provided to prevent operation of the swing if it is unacceptably overloaded. As will now be evident, and as is illustrated in FIG. 6, the extension 62 oscillates with the power arm 50 and power is intermittently supplied to the solenoid 56 as short pulses of current having a duration of less than about one-half second, as the timing lever depresses the microswitch and closes the circuit.

Figure 2:
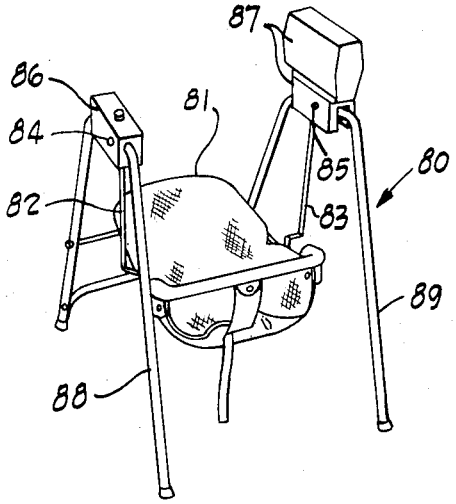
FIG. 2 is a perspective view from a slight elevation showing an infant's swing in which the seat is supported by oppositely disposed stub shafts instead of a main shaft, resulting in an "open" structure.

Another preferred embodiment of the invention is illustrated in FIG. 2 which shows an infant-swinging structure 80 from a slight elevation and in perspective view, with portions broken away, in which view a seat 81 is supported by drop-arms or hangers 82 and 83 respectively, only one hanger on each side of the seat 81. The seat may be of any conventional design, as explained hereinabove, provided it supports the infant in a reclining, supine or semi-sitting position.

Drop-arms 82 and 83 are supported for radially rigid to-and-fro oscillation in hanger blocks (not shown) keyed to oppositely disposed stub-shafts 84 and 85 respectively, to permit oscillation of the seat through an arc of less than about one-fourth of the circumference of the circle which might be circumscribed by a radius equivalent to the length of a drop-arm. Each stub-shaft is supported in roller bearing means (not shown) in separate housings 86 and 87 respectively, and one of the housings 86 also houses the solenoid-driven power train having the same power arm and other components, and assembled in an analogous structure as described hereinbefore, and which need not be described in further detail for one skilled in the art.

Each housing is fitted upon inverted generally V-shaped ground-engaging support means 88 and 89, the peaks of which extend vertically for about 2 or 3 feet, but always to a greater distance than the radius of the arc through which the seat oscillates. The housing 86 also houses a battery (not shown) which is connected to provide electric current to operate the solenoid-driven power train in the same circuit illustrated in FIG. 7. In this embodiment it will be evident that the infant may be placed or removed from the seat 81 from directly thereabove because of the swing's "open" structure.

The operation of the device is as follows: An infant is placed in the seat and oscillation of the swing and infant is initiated with a push. Since the power arm 50 is attached integrally to the main shaft 20 for rotation therewith, the power arm moves rearwards in an "up" motion until it reaches the top of the arc. The swing now commences its "down" mode which is the first half cycle of the forward movement of the seat in its pendulum motion. Because the timing lever rests against the shoulder 65, it moves with the power arm and is unable to pivot. When the tip of finger 69 touches the microswitch 58 (through return spring 73) the finger is still unable to pivot and therefore depresses the microswitch to turn it ON. As the timing lever 63 continues to move forward with the power arm, it maintains contact with the microswitch until it reaches the vertical. As soon as the finger moves past vertical, that is, as the infant commences the "up" arc coming forward, the return spring on the microswitch forces the timing lever to pivot, as shown in phantom outline, and turns OFF the microswitch.

During the return stroke, as the power arm and timing lever commence their "down" mode with the infant swinging to the rear, when the finger 69 touches the microswitch's return spring 73, the timing lever 63 is free to pivot and therefore does not depress the microswitch and does not turn it ON. As the power arm continues to move rearwards in the "down" mode, it reaches and then goes past dead center. As soon as the timing lever goes past dead center, the momentum of the screw 71 immediately biases the timing lever against the shoulder 65, and the swing is ready to start the cycle over again.

The power consumption is kept to a minimum because, with the ON-OFF switch in the ON position, during the forward stroke, as soon as the microswitch contacts are made, an electrical impulse is provided to the solenoid 56. The solenoid pulls the plunger 55 momentarily, and then turns off as soon as the contacts of the microswitch are released. The plunger 55 transmits the pulling force to the extension spring 54 which pulls on the power arm while the spring is in the extended position, thus exerting an 'elastic' pulling action which compensates for and matches the linear velocity of the plunger with the angular velocity of the power arm. The momentary torque transmitted to the main shaft by the power arm is sufficient to maintain oscillation of the swing until the power is turned OFF, or the batteries are discharged. When the batteries are discharged they are recharged through a battery charger such as is conventionally available, or the power to the swing may be provided directly by a D-C adapter connected to electrical mains such as the 110 volt or 220 volt mains conventionally provided.

I claim:

1. In an electrically powered device for reciprocably swinging an infant in a pendulum motion, the improvement comprising, (a) support shaft means to which an infant-support means or 'seat' is removably attached;

(b) support frame means comprising housing means in which said support shaft means is housed, and support legs for supporting said housing means attached thereto;

(c) relatively rigid hanger means connecting said seat to said support shaft means for positive to-and-fro oscillation of said seat;

(d) bearing means in said housing means in which bearing means said support shaft means is rotatably held;

(e) an elongated power arm fixedly disposed to said support shaft means, said power arm including an extension thereof;

(f) solenoid means including a reciprocable plunger, said solenoid being fixedly mounted relative to said housing means;

(g) extensible spring means drivingly interconnecting said power arm and said plunger;

(h) switch means, actuatable by said power arm, to provide current intermittently to said solenoid; and, (i) a source of electric current to be supplied to said solenoid at a voltage no greater than about 24 volts.

2. The device of claim 1 wherein said source for electric current is a battery capable of providing said current at less than 3 amperes and at from about 3 to about 4 volts.

3. The device of claim 1 wherein said source for electric current is a transformer capable of providing said current at less than 3 amperes and at from about 3 to about 4 volts.

4. The device of claim 1 including trigger means pivotably mounted on said extension for rotation in one direction only.

5. The device of claim 4 wherein said trigger means is a stub extension, one end of which actuates said switch means.

6. The device of claim 1 wherein said relatively rigid hanger means consists of rigid hanger means supporting the rear of said seat and flexible hanger means supporting the front thereof.

7. The device of claim 1 wherein said extensible spring is a helical spring having a spring rate in the range from about 20 lb/in to about 35 lb/in.

8. The device of claim 1 wherein said current is intermittently supplied to said solenoid in pulses each of which has a duration of less than about 0.5 second.

* * * * *